US008689550B2

(12) United States Patent
Wada et al.

(10) Patent No.: US 8,689,550 B2
(45) Date of Patent: Apr. 8, 2014

(54) HYDRAULIC CONTROL SYSTEM IN WORKING MACHINE

(75) Inventors: Atsushi Wada, Hineji (JP); Keisuke Shirani, Akashi (JP); Takashi Iguchi, Tokyo (JP)

(73) Assignee: Caterpillar SARL, Geneva (CH)

( * ) Notice: Subject to any disclaimer, the term of this patent is extended or adjusted under 35 U.S.C. 154(b) by 543 days.

(21) Appl. No.: 13/124,519

(22) PCT Filed: Jun. 1, 2009

(86) PCT No.: PCT/JP2009/002414

§ 371 (c)(1),
(2), (4) Date: Apr. 15, 2011

(87) PCT Pub. No.: WO2010/047008

PCT Pub. Date: Apr. 29, 2010

(65) Prior Publication Data

US 2011/0197576 A1 Aug. 18, 2011

(30) Foreign Application Priority Data

Oct. 22, 2008 (JP) ..... 2008-271759

(51) Int. Cl.
*F16D 31/02* (2006.01)

(52) U.S. Cl.
USPC ..... 60/414; 60/421; 60/429; 60/452

(58) Field of Classification Search
USPC ..... 60/413, 414, 421, 428, 429, 452
See application file for complete search history.

(56) References Cited

U.S. PATENT DOCUMENTS 5,355,676 A * 10/1994 Inokuchi ..... 60/452
2010/0000209 A1* 1/2010 Wada et al. ..... 60/413

FOREIGN PATENT DOCUMENTS

| | | |
|---|---|---|
| JP | A-2-227571 | 9/1990 |
| JP | A-6-221301 | 8/1994 |
| JP | A-2008-89024 | 4/2008 |
| JP | A-2008-185182 | 8/2008 |
| WO | WO 98/13603 | 4/1998 |

OTHER PUBLICATIONS

International Search Report mailed Sep. 1, 2009 in International Application No. PCT/JP2009/002414 (with translation).

* cited by examiner

*Primary Examiner* — Michael Leslie
(74) *Attorney, Agent, or Firm* — Oliff & Berridge

(57) ABSTRACT

A hydraulic control system that includes a controller that controls the accumulator flow rate control valve and a discharge flow rate of the hydraulic pump, wherein the controller: determines a minimum value among an operation demand flow rate to be demanded by an operation amount of hydraulic actuator operating members, a pump flow rate to be determined by a discharge pressure of the hydraulic pump under a constant horsepower control and a maximum flow rate of the hydraulic pump such that the determined minimum value is an actuator supply flow rate to be supplied to the plurality of hydraulic actuators, and controls the discharge flow rate and the accumulator flow rate so as to supply the actuator supply flow rate corresponding to a total flow rate of the discharge flow rate and the accumulator flow rate.

5 Claims, 4 Drawing Sheets

HYDRAULIC CONTROL SYSTEM IN WORKING MACHINE

CROSS-REFERENCE TO RELATED APPLICATION

This application is the U.S. National Phase of PCT/JP2009/002414, filed Jun. 1, 2009, which claims priority from JP2008-271759, filed Oct. 22, 2008, the entire disclosure of which is incorporated herein by reference hereto.

BACKGROUND

The present invention relates to a hydraulic control system in a working machine.

There exists a working machine, such as a hydraulic shovel, that includes a plurality of hydraulic actuators to which pressurized oil is supplied from a hydraulic pump. A conventional hydraulic circuit of the working machine is configured such that oil discharged from the hydraulic actuators is returned to an oil tank. In the hydraulic shovel, for example, oil discharged from a head-side oil chamber of a boom cylinder is returned to the oil tank when the boom cylinder is retracted to lower a working portion. The oil in the head-side oil chamber of the boom cylinder, which holds a weight of a front working portion, contains high pressure and hydraulic energy. However, the high hydraulic energy is returned to the oil tank without being used further, with a resultant loss of energy.

The hydraulic energy contained in the discharged oil from the hydraulic actuator is pressure-accumulated in an accumulator and pressure-accumulated oil in the accumulator is allowed to merge into a discharge passage of a hydraulic pump in order to recover and recycle the hydraulic energy of the discharged oil from the hydraulic actuator (see WO 98/13603, for example). Further, the pressure-accumulated oil in the accumulator is allowed to merge into the pump discharge passage with a pressure of the pressure-accumulated oil being unchanged or being increased by a pump motor in accordance with a pressure difference between an accumulated pressure in the accumulator and a discharged pressure from the pump.

SUMMARY

However, a flow rate in the pump discharge passage is likely to increase corresponding to a merging flow rate from the accumulator because the pressure-accumulated oil in the accumulator merges into the discharge passage of the hydraulic pump as disclosed in WO 98/13603. When a discharge flow rate of the hydraulic pump is not controlled along with a merging flow rate from the accumulator, a pressure of the pump discharge passage increases and a pressure loss also increases in a control valve that controls a supply flow rate of the pressurized oil to the hydraulic actuator, which consumes more energy. Thus, the pressure-accumulated oil in the accumulator cannot efficiently be reused by the above configurations. Further, an operation speed of the hydraulic actuator increases or decreases according to an increase or decrease in the merging flow rate from the accumulator to the hydraulic pump discharge passage. The present invention solves the problems and is able to achieve various advantages.

The present invention has been made with the object of resolving the above problems in view of the above circumstances, and a first exemplary aspect of the present invention provides a hydraulic control system in a working machine that includes a plurality of hydraulic actuators; an accumulator that pressure-accumulates hydraulic energy contained in oil discharged from a hydraulic actuator of the plurality of hydraulic actuators; a variable-capacity hydraulic pump that serves as a hydraulic supply source for the plurality of hydraulic actuators; a merging oil passage that allows pressure-accumulated oil in the accumulator to merge into oil discharged from the hydraulic pump; an accumulator flow rate control valve that controls an accumulator flow rate to be merged from the accumulator into the oil discharged from the hydraulic pump; and a controller that controls the accumulator flow rate control valve and a discharge flow rate of the hydraulic pump. The controller: determines a minimum value among an operation demand flow rate to be demanded by an operation amount of hydraulic actuator operating members, a pump flow rate to be determined by a discharge pressure of the hydraulic pump under a constant horsepower control and a maximum flow rate of the hydraulic pump such that the determined minimum value is an actuator supply flow rate to be supplied to the plurality of hydraulic actuators, and controls the discharge flow rate and the accumulator flow rate so as to supply the actuator supply flow rate corresponding to a total flow rate of the discharge flow rate and the accumulator flow rate.

A second exemplary aspect of the present invention provides the hydraulic control system in the working machine according to the first aspect, in which the controller: arbitrarily sets an accumulator contribution proportion to be contributed by the accumulator and a pump contribution proportion to be contributed by the hydraulic pump of the actuator supply flow rate to be supplied to the hydraulic actuators, and determines the accumulator flow rate to be merged from the accumulator into the oil discharged from the hydraulic pump by multiplying the actuator supply flow rate by the accumulator contribution proportion if an accumulator pressure that is detected is more than or equal to a predetermined pressure at which the accumulator is allowed to release pressurized oil and if the detected accumulator pressure is more than or equal to the discharge pressure of the hydraulic pump.

A third exemplary aspect of the present invention provides the hydraulic control system in the working machine according to the first or second aspect, in which the controller controls an opening area of the accumulator flow rate control valve based on a pressure difference between the accumulator pressure and the discharge pressure of the hydraulic pump that are respectively detected by controller so as to compensate the accumulator flow rate to be merged from the accumulator into the oil discharged from the hydraulic pump.

According to the first exemplary aspect of the present invention, the actuator supply flow rate, which is determined based on the operation amount of the hydraulic actuator operating members and the discharged pressure from the hydraulic pump, is allowed to be supplied without an excess or deficiency to the hydraulic actuators by the accumulator flow rate and the discharge flow rate of the main pump. The pressure-accumulated oil in the accumulator can be used efficiently without being wasted, the discharge flow rate of the hydraulic pump can be reduced, and reliable energy saving can be accomplished.

According to the second exemplary aspect of the present invention, the accumulator flow rate is controlled to contribute a predetermined proportion of the actuator supply flow rate. An easy calculation and control of the accumulator flow rate and an easy discharge flow rate control of the hydraulic pump are thus provided.

According to the third exemplary aspect of the present invention, even when the accumulator pressure and the main pump discharge pressure vary, the accumulator flow rate that merges from the accumulator to the discharged oil from the hydraulic pump can be controlled precisely. The supply flow rate to the hydraulic actuators is thus stabilized and a smooth operation of the hydraulic actuators is achieved.

BRIEF DESCRIPTION OF THE DRAWINGS

Various exemplary aspects will be described with reference to the drawings, wherein.

DETAILED DESCRIPTION OF EMBODIMENTS

Figure 1:
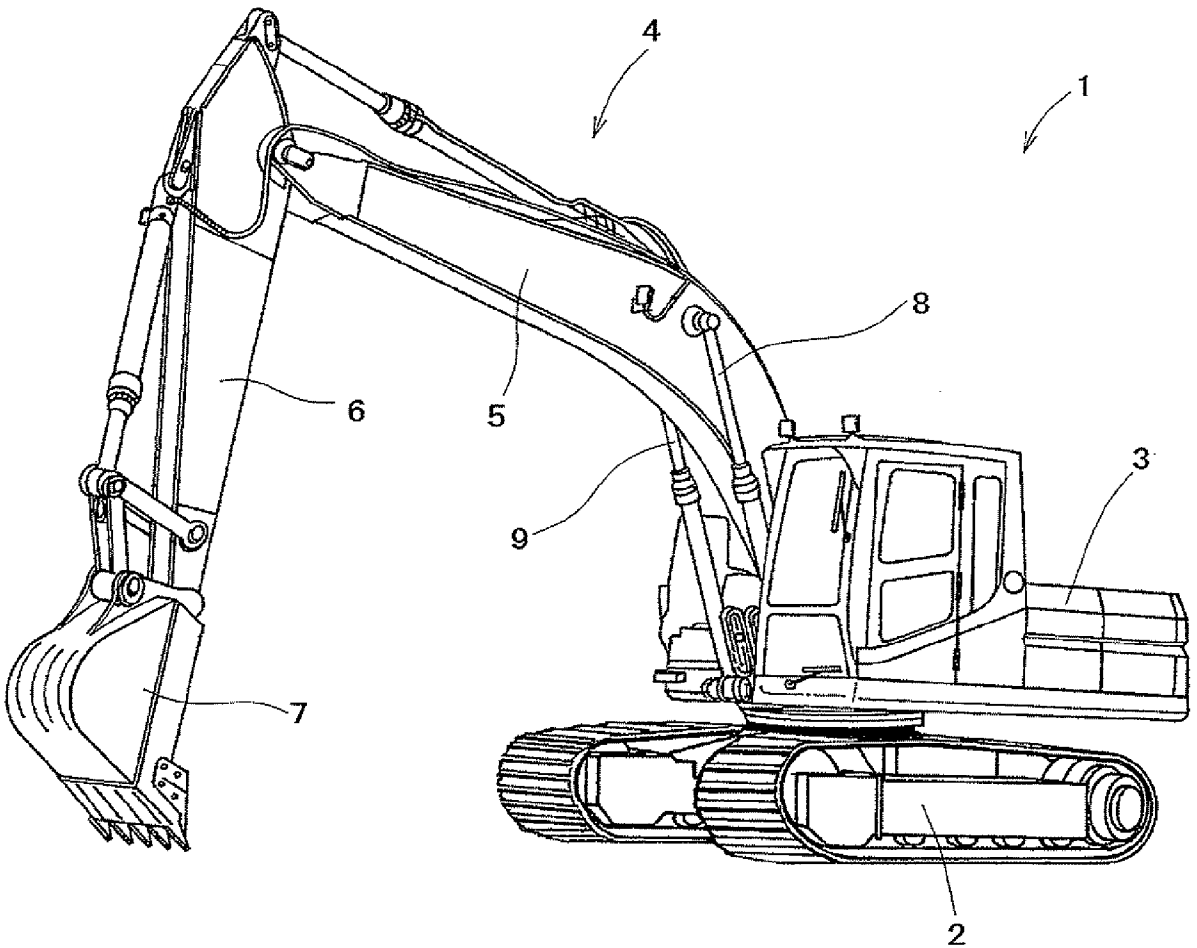
FIG. 1 is a perspective view of a hydraulic shovel.

An embodiment of the present invention will be discussed based on the drawings. In FIG, 1, a hydraulic shovel 1, which is an example of a working machine, includes various portions such as a crawler-type lower traveling body 2; an upper rotating body 3 rotatably supported above the lower traveling body 2; and a working portion 4 fit to a front portion of the upper rotating body 3. The working portion 4 includes a boom 5 with a base end portion being supported on the upper rotating body 3 to swing up or down; an arm 6 supported on a leading end portion of the boom 5 to swing forward or rearward; and a bucket 7 attached to a leading end portion of the arm 6.

A left and right pair of first and second boom cylinders 8 and 9 swings the boom 5 up and down. The first and second boom cylinders 8 and 9 hold a weight of the working portion 4 by a pressure in head-side oil chambers 8*a* and 9*a*; extend to raise the boom 5 by pressurized oil supplied to the head-side oil chambers 8*a* and 9*a* and oil discharged from rod-side oil chambers 8*b* and 9*b*; and retract to lower the boom 5 by pressurized oil supplied to the rod-side oil chambers 8*b* and 9*b* and oil discharged from the head-side oil chambers 8*a* and 9*a*. The working portion 4 entirely moves up and down when the boom 5 is raised and lowered. A positional energy possessed by the working portion 4 increases when the boom 5 is raised. The positional energy can be recovered and reused by a hydraulic control system, which will be discussed blow.

Figure 2:
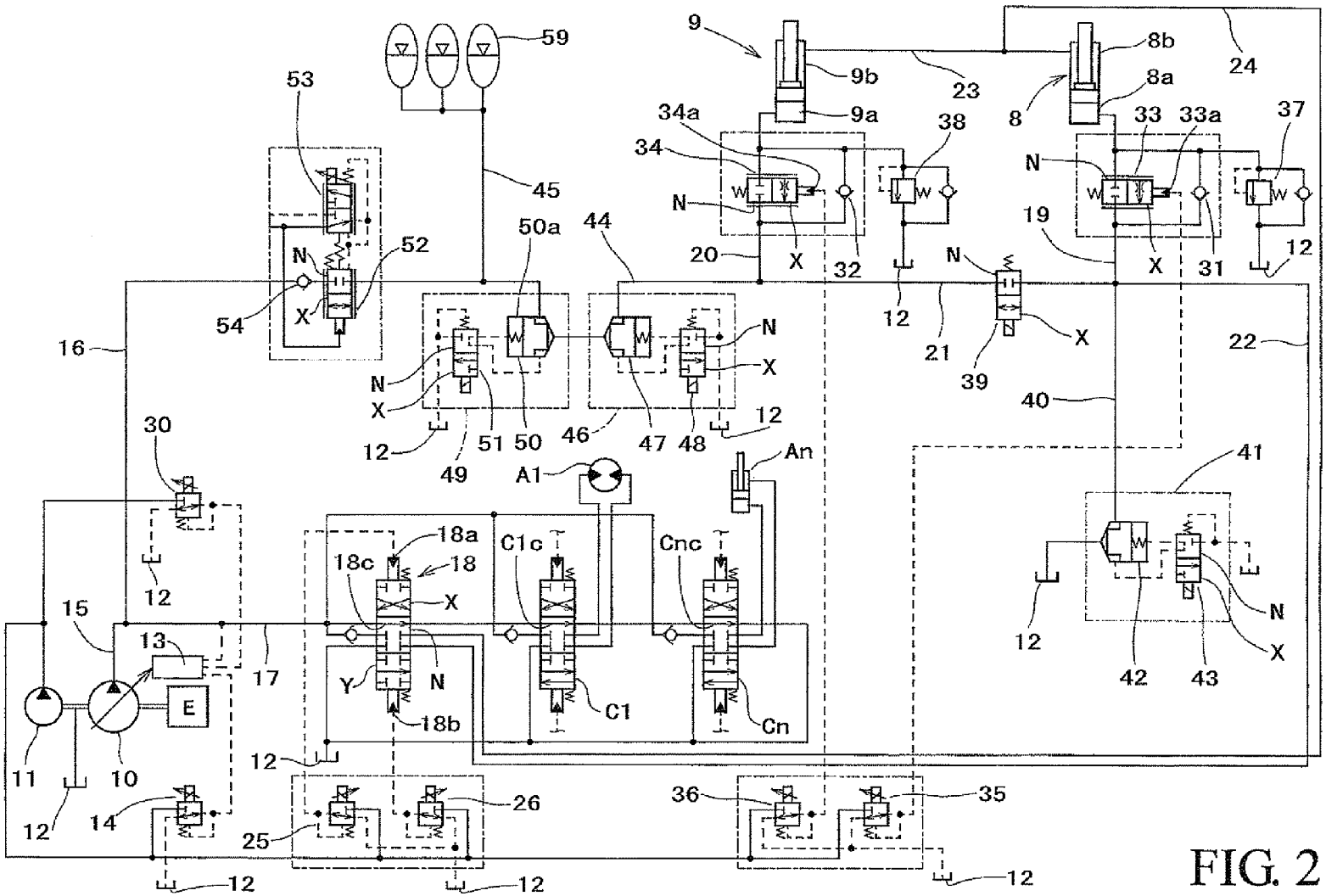
FIG. 2 is a hydraulic circuit diagram of a hydraulic control system.

The hydraulic control system will be discussed based on a hydraulic circuit diagram as illustrated in FIG. 2. Reference numerals 8 and 9 denote the first and second boom cylinders; reference numeral 10 denotes a variable-capacity main pump (corresponding to a hydraulic pump of the present invention) driven by an engine E installed in the hydraulic shovel 1; reference numeral 11 denotes a pilot pump serving as a pilot hydraulic power source; and reference numeral 12 denotes an oil tank in FIG. 2. The main pump 10 serves as a hydraulic supply source for not only the first and second boom cylinders 8 and 9 but also for a plurality of hydraulic actuators Al to An (traveling motor, rotating motor, arm cylinder, bucket cylinder, etc.) mounted in the hydraulic shovel 1. Nonetheless, only the hydraulic actuators Al and An among the plurality of hydraulic actuators Al to An are shown in FIG. 2. In the present embodiment, the second boom cylinder 9 corresponds to a hydraulic actuator of the present invention that pressure-accumulates hydraulic energy contained in discharged oil. The first and second boom cylinders 8 and 9 and the plurality of hydraulic actuators Al to An correspond to hydraulic actuators including at least the above hydraulic actuator of the present invention.

A regulator 13 controls a discharge flow rate of the main pump 10. The regulator 13 controls a pump output upon receiving a control signal pressure output from a main pump output controlling solenoid proportional pressure reducing valve 14 and also performs a constant horsepower control upon receiving a pressure discharged from the main pump 10. The regulator 13 also performs a flow rate control according to a flow rate control signal pressure Pc output from a main pump flow rate control solenoid proportional pressure reducing valve 30. Such flow rate control will be discussed later.

A discharge line 15 of the main pump 10 merges into a merging oil passage 16 and extends to a pressurized oil supplying oil passage 17. A boom cylinder control valve 18 is connected to the pressurized oil supplying oil passage 17 and performs an oil supply and discharge control over the first and second boom cylinders 8 and 9. Connected to the pressurized oil supplying oil passage 17 are also hydraulic actuator control valves C1 to Cn (traveling motor control valve, rotating motor control valve, arm cylinder control valve, bucket cylinder control valve, etc.) that respectively perform an oil supply and discharge control over the hydraulic actuators A1 to An. Nonetheless, only reference numerals C1 and Cn among the hydraulic actuator control valves C1 to Cn are shown in FIG. 2.

The boom cylinder control valve 18 is a spool valve that includes raising-side and lowering-side pilot ports 18*a* and 18*b*. When a pilot pressure is not input to both the pilot ports 18*a* and 18*b*, the boom cylinder control valve 18 is positioned at a neutral position N so as not to allow oil to be supplied to or discharged from the first and second boom cylinders 8 and 9. When a pilot pressure is input to the raising-side pilot port 18*a*, the boom cylinder control valve 18 switches to be positioned at a raising-side position X so as to allow pressurized oil in the pressurized oil supplying oil passage 17 to be supplied to the head-side oil chambers 8*a* and 9*a* of the first and second boom cylinders 8 and 9, and oil discharged from the rod-side oil chambers 8*b* and 9*b* to flow into the oil tank 12. When a pilot pressure is input to the lowering-side pilot port 18*b*, the boom cylinder control valve 18 switches to be positioned at a lowering-side position Y so as to allow pressurized oil in the pressurized oil supplying oil passage 17 to be supplied to the rod-side oil chambers 8*b* and 9*b* of the first and second boom cylinders 8 and 9.

The head-side oil chambers 8*a* and 9*a* of the first and second boom cylinders 8 and 9 are connected to the boom cylinder control valve 18 through first and second head-side oil passages 19 and 20, a head-side communicating oil passage 21 and a head-side main oil passage 22. The first and second head-side oil passages 19 and 20 are respectively connected to the head-side oil chambers 8*a* and 9*a* of the first and second boom cylinders 8 and 9. The head-side communicating oil passage 21 connects the head-side oil chamber 8*a* of the first boom cylinder 8 and the head-side oil chamber 9*a* of the second boom cylinder 9 through the first and second head-side oil passages 19 and 20. The head-side main oil passage 22 connects the head-side communicating oil passage 21 and the boom cylinder control valve 18. The rod-side oil chambers 8*b* and 9*b* of the first and second boom cylinders 8 and 9 and the boom cylinder control valve 18 are connected through a rod-side communicating oil passage 23 and a rod-side main oil passage 24. The rod-side communicating oil passage 23 connects the rod-side oil chamber 8*b* of the first boom cylinder 8 and the rod-side oil chamber 9*b* of the second boom cylinder 9. The rod-side main oil passage 24 connects the rod-side communicating oil passage 23 and the boom cylinder control valve 18. Oil supply and discharge is thus executable between the first and second boom cylinders 8 and 9 and the boom cylinder control valve 18 through the above-mentioned oil passages.

Raising-side and lowering-side solenoid proportional pressure reducing valves 25 and 26 are operable based on control signals from a controller 27 so as to output a pilot pressure respectively to the raising-side pilot port 18*a* and the lowering-side pilot port 18*b* of the boom cylinder control valve 18. The pilot pressure output from the raising-side and lowering-side solenoid proportional pressure reducing valves 25 and 26 is controlled to increase or decrease in response to an operation amount of a boom operating lever (not shown). An opening area of the boom cylinder control valve 18 is controlled to increase or decrease by increasing or decreasing a movement stroke of a spool in response to an increase or decrease in the pilot pressure.

A center bypass valve passage 18*c* is formed to the boom cylinder control valve 18. Pressurized oil in the pressurized oil supplying oil passage 17 is allowed to flow into the oil tank 12 when the boom cylinder control valve 18 is positioned at the neutral position N. The center bypass valve passage 18*c* is closed, even if a movement stroke of the spool is small, when the boom cylinder control valve 18 switches to be positioned at the raising-side position X or the lowering-side position Y. In addition, the hydraulic actuator control valves C1 to Cn include center bypass valve passages C1*c* to Cnc similar to the boom cylinder control valve 18.

Based on a control signal from the controller 27, a main pump flow rate control solenoid proportional pressure reducing valve 30 outputs a flow rate control signal pressure Pc. After being output from the main pump flow rate control solenoid proportional pressure reducing valve 30, the flow rate control signal pressure Pc is input into the regulator 13 that performs a discharge flow rate control of the main pump 10. The regulator 13 controls a discharge flow rate of the main pump 10 to minimize a pump flow rate when the input flow rate control signal pressure Pc is a maximum value and to increase a pump flow rate as the input flow rate control signal pressure Pc decreases.

The first and second head-side oil passages 19 and 20 are connected to the head-side oil chambers 8*a* and 9*a* of the first and second boom cylinders 8 and 9, as discussed above. First and second check valves 31 and 32 and first and second flow rate control valves 33 and 34 are disposed in parallel to the first and second head-side oil passages 19 and 20. The first and second check valves 31 and 32 respectively allow oil to be supplied into the head-side oil chambers 8*a* and 9*a* and prevent oil from discharging from the head-side oil chambers 8*a* and 9*a*. The first and second flow rate control valves 33 and 34 respectively control a discharge flow rate from the head-side oil chambers 8*a* and 9*a*. Thus, oil is supplied into the head-side oil chambers 8*a* and 9*a* of the first and second boom cylinders 8 and 9 through the first and second check valves 31 and 32 and discharged from the head-side oil chambers 8*a* and 9*a* of the first and second boom cylinders 8 and 9 through the first and second flow rate control valves 33 and 34.

The first and second flow rate control valves 33 and 34 are spool valves that respectively include pilot ports 33*a* and 34*a*. When a pilot pressure is not applied to the pilot ports 33*a* and 34*a*, the first and second flow rate control valves 33 and 34 are positioned at a closed position N to close the first and second head-side oil passages 19 and 20. When a pilot pressure is input to the pilot ports 33*a* and 34*a*, the first and second flow rate control valves 33 and 34 switches to be positioned at an open position X to open the first and second head-side oil passages 19 and 20.

First and second solenoid proportional pressure reducing valves 35 and 36 operate based on a control signal from the controller 27 so as to output a pilot pressure respectively to the pilot ports 33*a* and 34*a* of the first and second flow rate control valves 33 and 34. An opening area of the first and second flow rate control valves 33 and 34 is controlled to increase or decrease in response to an increase or decrease in the pilot pressure output from the first and second solenoid proportional pressure reducing valves 35 and 36.

First and second relief valves 37 and 38 are respectively connected to the first and second head-side oil passages 19 and 20. A head-side relief pressure of the first and second boom cylinders 8 and 9 is set by the first and second relief valves 37 and 38.

Disposed to the head-side communicating oil passage 21, which connects the head-side oil chambers 8*a* and 9*a* of the first and second boom cylinders 8 and 9 through the first and second head-side oil passages 19 and 20, is a head-side communicating oil passage opening and closing valve 39 that opens or closes the head-side communicating oil passage 21 based on a control signal from the controller 27. The head-side oil chambers 8*a* and 9*a* of the first and second boom cylinders 8 and 9 communicate with each other through the first and second head-side oil passages 19 and 20 when the head-side communicating oil passage opening and closing valve 39 is positioned at an open position X to open the head-side communicating oil passage 21. The head-side oil chambers 8*a* and 9*a* of the first and second boom cylinders 8 and 9 are blocked from each other when the head-side communicating oil passage opening and closing valve 39 is positioned at a closing position N to close the head-side communicating oil passage 21. The rod-side oil chambers 8*b* and 9*b* of the first and second boom cylinders 8 and 9 constantly communicate with each other because an opening and closing valve such as the head-side communicating oil passage opening and closing valve 39 is not disposed to the rod-side communicating oil passage 23.

A head-side oil discharge passage 40 extends to the oil tank 12 from the first head-side oil passage 19. An unload valve 41 is disposed to the head-side oil discharge passage 40.

The unload valve 41 includes a poppet valve 42 and an unload valve solenoid switching valve 43. The unload valve solenoid switching valve 43 is switchable from an OFF position N to an ON position X based on a control signal output from the controller 27. When the unload valve solenoid switching valve 43 is positioned at an OFF position N, the unload valve 41 stays closed to prevent an oil flow from the first head-side oil passage 19 to the oil tank 12, i.e., to close the head-side oil discharge passage 40. When the unload valve solenoid switching valve 43 switches to be positioned at an ON position X, the unload valve 41 is open to allow for an oil flow from the first head-side oil passage 19 to the oil tank 12, i.e., to open the head-side oil discharge passage 40. The open state of the unload valve 41 caused by positioning the unload valve solenoid switching valve 43 at the ON position X thus allows pressurized oil in the head-side oil chamber 8*a* of the first boom cylinder 8 to flow into the oil tank 12 through the first flow rate control valve 33 and the head-side oil discharge passage 40.

The pressurized oil in the head-side oil chamber 8*a* of the first boom cylinder 8 is allowed to flow into the oil tank 12 through the first flow rate control valve 33 and the head-side oil discharge passage 40 when the unload valve 41 is open. In this case, maximizing an opening area of the first flow rate control valve 33 enables the pressurized oil in the head-side oil chamber 8*a* of the first boom cylinder 8 to flow into the oil tank 12 in a substantially unloaded state.

A recovery oil passage 44 is connected to the second head-side oil passage 20. Supplied to the recovery oil passage 44 is oil discharged from the head-side oil chamber 9*a* of the second boom cylinder 9 through the second head-side oil passage 20. The recovery oil passage 44 is also connected to an accumulator oil passage 45 through a cylinder-side check valve 46 and an accumulator-side check valve 49 as discussed below. The accumulator oil passage 45 is connected to an accumulator 59 to supply and discharge pressurized oil to and from the accumulator 59.

The cylinder-side check valve 46 includes a poppet valve 47 and a cylinder-side check valve solenoid switching valve 48. The cylinder-side check valve solenoid switching valve 48 is switchable from an OFF position N to an ON position X based on a control signal output from the controller 27. The cylinder-side check valve 46 stays closed to prevent an oil flow from the recovery oil passage 44 to the accumulator oil passage 45 when the cylinder-side check valve solenoid switching valve 48 is positioned at an OFF position N. When the cylinder-side check valve solenoid switching valve 48 switches to be positioned at an ON position X, the cylinder-side check valve 46 is open to allow for a bidirectional flow between the recovery oil passage 44 and the accumulator oil passage 45.

The accumulator-side check valve 49 includes a poppet valve 50 and an accumulator-side check valve solenoid switching valve 51. The accumulator-side check valve solenoid switching valve 51 is switchable from an OFF position N to an ON position X based on a control signal output from the controller 27. The accumulator-side check valve 49 stays closed to prevent an oil flow from the accumulator oil passage 45 to the recovery oil passage 44 when the accumulator-side check valve solenoid switching valve 51 is positioned at an OFF position N. When the accumulator-side check valve solenoid switching valve 51 switches to be positioned at an ON position X, the accumulator-side check valve 49 is open to allow for a bidirectional flow between the recovery oil passage 44 and the accumulator oil passage 45. The accumulator-side check valve 49 allows for an oil flow from the recovery oil passage 44 to the accumulator oil passage 45 even when the accumulator-side check valve solenoid switching valve 51 is positioned at the OFF position N. When the accumulator-side check valve solenoid switching valve 51 is positioned at the ON position X, oil is allowed to flow from the recovery oil passage 44 to the accumulator oil passage 45 by losing little pressure because no pressure in the accumulator oil passage 45 is applied to a spring chamber 50*a* of the poppet valve 50.

Oil is prevented from flowing from the recovery oil passage 44 to the accumulator oil passage 45 and from the accumulator oil passage 45 to the recovery oil passage 44 when both the cylinder-side check valve 46 and the accumulator-side check valve 49 stay closed, Oil discharged from the head-side oil chamber 9*a* of the second boom cylinder 9 can be pressure-accumulated in the accumulator 59 through the recovery oil passage 44 and the accumulator oil passage 45 when both the cylinder-side check valve 46 and the accumulator-side check valve 49 are open. The accumulator 59 of the present embodiment is an optimal bladder type accumulator for storing hydraulic energy, but is not restricted thereto and may be a piston type, for example.

The merging oil passage 16 extends from the accumulator oil passage 45 to the discharge line 15 of the main pump 10. An accumulator flow rate control valve 52 is disposed to the merging oil passage 16.

A spool of the accumulator flow rate control valve 52 moves based on an operation of an accumulator flow rate control valve electro-hydraulic conversion valve 53 into which a control signal is input from the controller 27. When the accumulator flow rate control valve electro-hydraulic conversion valve 53 is unoperated, the accumulator flow rate control valve 52 is positioned at a closed state N to close the merging oil passage 16. A movement of the spool by an operation of the accumulator flow rate control valve electro-hydraulic conversion valve 53 causes the accumulator flow rate control valve 52 to switch to be positioned at an open position X to open the merging oil passage 16. A check valve 54 is integrated into the accumulator flow rate control valve 52. The check valve 54 allows for an oil flow from the accumulator oil passage 45 to the discharge line 15 and prevents an oil flow in a reverse direction thereof. When the accumulator flow rate control valve 52 switches to be positioned at the open position X, pressurized oil that is pressure-accumulated in the accumulator 59 is allowed to merge into the discharge line 15 of the main pump 10 through the accumulator oil passage 45 and the merging oil passage 16.

An opening area of the accumulator flow rate control valve 52 is controlled to increase or decrease according to a signal value of a control signal input from the controller 27 to the accumulator flow rate control valve electro-hydraulic conversion valve 53. The opening area of the accumulator flow rate control valve 52 controls an accumulator flow rate that merges from the accumulator 59 into the discharge line 15 of the main pump 10 through the merging oil passage 16, which will be discussed more later.

Figure 3:
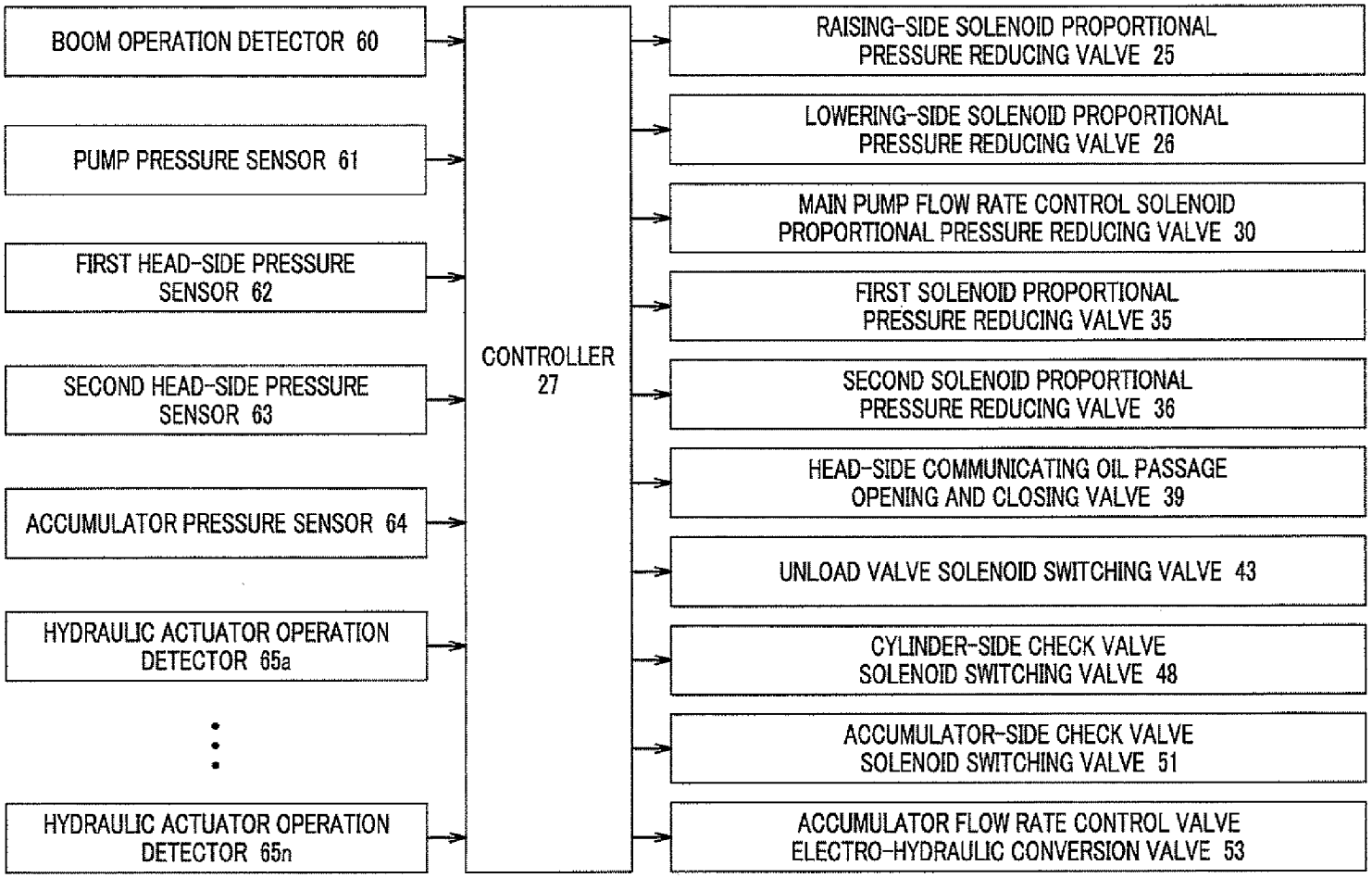
FIG. 3 is a block diagram showing inputs to and outputs from a controller.

The controller 27, which includes a microcomputer, etc., inputs signals from a boom operation detector 60, a pump pressure sensor (corresponding to a pump pressure detector of the present invention) 61, a first head-side pressure sensor 62, a second head-side pressure sensor 63, an accumulator pressure sensor (corresponding to an accumulator pressure detectors of the present invention) 64, hydraulic actuator operation detectors 65*a* to 65*n* and so on as illustrated in a block diagram of FIG. 3. The boom operation detecting means 60 detects an operation direction and amount of the boom operating lever. The pump pressure sensor 61 detects a pressure of the main pump 10. The first head-side pressure sensor 62 detects a pressure of the head-side oil chamber 8*a* of the first boom cylinder 8. The second head-side pressure sensor 63 detects a pressure of the head-side oil chamber 9*a* of the second boom cylinder 9. The accumulator pressure sensor 64 detects a pressure of the accumulator 59. The hydraulic actuator operation detector 65*a* to 65*n* detect an operation direction and amount of operating members (not shown) for the hydraulic actuators Al to An. Based on the input signals, the controller 27 outputs control signals to the raising-side solenoid proportional pressure reducing valve 25, the lowering-side solenoid proportional pressure reducing valve 26, the main pump flow rate control solenoid proportional pressure reducing valve 30, the first solenoid proportional pressure reducing valve 35, the second solenoid proportional pressure reducing valve 36, the head-side communicating passage opening and closing valve 39, the unload valve solenoid switching valve 43, the cylinder-side check valve solenoid switching valve 48, the accumulator-side check valve solenoid switching valve 51, the accumulator flow rate control valve electro-hydraulic conversion valve 53 and so on.

A bilateral and unilateral holding control will first be discussed before other controls performed by the controller 27. Based on a boom operating lever operation signal input from the boom operation detector 60, the controller 27 judges to perform a bilateral holding control so as to hold a weight of the working portion 4 by a pressure of the head-side oil chambers 8*a* and 9*a* of the first and second boom cylinders 8 and 9 when the boom operating lever is unoperated to both lowering and raising sides or operated to a raising side, i.e., when a raising and lowering operation of the working portion 4 is halted or the working portion 4 is raised. Based on a boom operating lever operation signal input from the boom operation detector 60, the controller 27 judges to perform a unilateral holding control so as to hold a weight of the working portion 4 by a pressure of the head-side oil chamber 9*a* of the second boom cylinder 9 when the boom operating lever is operated to a lowering side, i.e., when the working portion 4 is lowered.

Judging to perform the bilateral holding control, the controller 27 outputs a control signal to the unload valve solenoid switching valve 43 to be positioned at an OFF position N so as to close the unload valve 41. Oil in the head-side oil chamber 8*a* of the first boom cylinder 8 is thus prevented from flowing into the oil tank 12 through the head-side oil discharge passage 40. The controller 27 also outputs a control signal to the head-side communicating oil passage opening and closing valve 39 to be positioned at an open position X. The head-side oil chambers 8*a* and 9*a* of the first and second boom cylinders 8 and 9 are thus connected with each other through the first and second head-side oil passages 19 and 20. In this state, both the first and second boom cylinders 8 and 9 are involved in holding the weight of the working portion 4. The bilateral holding control is thus performed to hold the weight of the working portion 4 by the pressure of both the head-side oil chambers 8*a* and 9*a* of the first and second boom cylinders 8 and 9.

Judging to perform the unilateral holding control, the controller 27 outputs a control signal to the head-side communicating oil passage opening and closing valve 39 to be positioned at a closed position N. The head-side oil chambers 8*a* and 9*a* of the first and second boom cylinders 8 and 9 are thus blocked from each other. The controller 27 also outputs a control signal for a maximum pilot pressure output to the first solenoid proportional pressure reducing valve 35 so as to maximize an opening area of the first flow rate control valve 33. The controller 27 also outputs a control signal to the unload valve solenoid switching valve 43 to be positioned at an ON position X so as to open the unload valve 41. Oil in the head-side oil chamber 8*a* of the first boom cylinder 8 thus flows into the oil tank 12 through the first head-side oil passage 19 and the head-side oil discharge passage 40, which in return decreases a pressure of the head-side oil chamber 8*a* of the first boom cylinder 8 down to substantially a pressure of the oil tank 12. In this state, the weight of the working portion 4 is not held by the first boom cylinder 8, and only the second boom cylinder 9 is involved in holding the weight of working portion 4. The unilateral holding control is thus performed to hold the weight of the working portion 4 by the pressure of the head-side oil chamber 9*a* of the second boom cylinder 9, which is one of the first and second boom cylinders 8 and 9. The pressure of the head-side oil chamber 9*a* of the second boom cylinder 9 in the unilateral holding control rises approximately twice as much as the pressure of the head-side oil chambers 8*a* and 9*a* of the first and second boom cylinders 8 and 9 in the bilateral holding control.

Controls by the controller 27 will now be discussed in connection with operations of the boom operating lever.

The controller 27 outputs no pilot pressure output control signal to the raising-side solenoid proportional pressure reducing valve 25, the lowering-side solenoid proportional pressure reducing valve 26, the first solenoid proportional pressure reducing valve 35 and the second solenoid proportional pressure reducing valve 36 when the boom operating lever is unoperated to both boom lowering and raising sides, i.e., a raising and lowering operation of the working portion 4 is stopped. The boom cylinder control valve 18 is thus positioned at a neutral position N, and also the first and second flow rate control valves 33 and 34 are positioned at a closed position N. Further, both the cylinder-side check valve solenoid switching valve 48 and the accumulator-side check valve solenoid switching valve 51 are controlled to be positioned at an OFF position N, which in return allows both the cylinder-side check valve 46 and the accumulator-side check valve 49 to stay closed. Further, an operation signal is not output to the accumulator flow rate control valve electro-hydraulic conversion valve 53, which in return allows the accumulator flow rate control valve 52 to be positioned at a closed position N. Further, the control is performed such that the head-side communicating oil passage opening and closing valve 39 is positioned at an open position X and the unload valve 41 is closed because of the bilateral holding control when the raising and lowering operation of the working portion 4 is stopped as discussed above. Further, the main pump flow rate control solenoid proportional pressure reducing valve 30 is controlled to output a maximum value of the flow rate control signal pressure Pc to the regulator 13. The main pump 10 is thus controlled to operate at a minimum pump flow rate.

On the other hand, another control is performed such that the head-side communicating oil passage opening and closing valve 39 is positioned at a closed position N, an opening area of the first flow rate control valve 33 is maximized, and the unload valve 41 is open because of the unilateral holding control when the boom operating lever is operated to a boom lowering side, i.e., the working portion 4 is lowered, as discussed above. Oil discharged from the head-side oil chamber 8*a* of the first boom cylinder 8 thus flows into the oil tank 12 through the head-side oil discharge passage 40, and the weight of the working portion 4 is held by the pressure of the head-side oil chamber 9*a* of the second boom cylinder 9.

When the boom operating lever is operated to the boom lowering side, the controller 27 outputs a control signal to the lowering-side solenoid proportional pressure reducing valve 26 to output a pilot pressure corresponding to an amount of the operation of the boom operating lever to the lowering-side pilot port 18*b* of the boom cylinder control valve 18. The boom cylinder control valve 18 thus switches to be positioned at a lowering-side position Y. Pressurized oil in the pressurized oil supplying oil passage 17 is supplied to the rod-side oil chambers 8*b* and 9*b* of the first and second boom cylinders 8 and 9 through the boom cylinder control valve 18 at the lowering-side position Y, the rod-side main oil passage 24 and the rod-side communicating oil passage 23.

When the boom operating lever is operated to the boom lowering side, the controller 27 also outputs a control signal to the second solenoid proportional pressure reducing valve 36 to output a pilot pressure corresponding to the operation amount of the boom operating lever to the pilot port 34*a* of the second flow rate control valve 34. The second flow rate control valve 34 thus switches to be positioned at an open position X so as to open the second head-side oil passage 20. Pressurized oil discharged from the head-side oil chamber 9*a* of the second boom cylinder 9 is supplied to the recovery oil passage 44 through the second flow rate control valve 34 at the open position X. A flow rate of the pressurized oil is controlled by an opening area of the second flow rate control valve 34. Compared with the bilateral holding control, the pressure of the oil discharged from the head-side oil chamber 9*a* of the second boom cylinder 9 is approximately twice as much because of the unilateral holding control where the working portion 4 is lowered and the weight of the working portion 4 is held by the head-side oil chamber 9*a* of the second boom cylinder 9, as discussed above. The high-pressure oil is supplied to the recovery oil passage 44.

When the boom operating lever is operated to the boom lowering side, the controller 27 also outputs a control signal to the cylinder-side check valve solenoid switching valve 48 and the accumulator-side check valve solenoid switching valve 51 to switch to be positioned at an ON position X. Both the cylinder-side check valve 46 and the accumulator-side check valve 49 are thus open to allow for an oil flow from the recovery oil passage 44 to the accumulator oil passage 45. The oil, which is discharged from the head-side oil chamber 9*a* of the second boom cylinder 9 and supplied to the recovery oil passage 44, flows into the accumulator oil passage 45 to be pressure-accumulated in the accumulator 59 through the accumulator oil passage 45.

In other words, when the working portion 4 is lowered, the unilateral holding control is performed to hold the weight of the working portion 4 by the pressure of the head-side oil chamber 9*a* of the second boom cylinder 9, and the oil discharged from the head-side oil chamber 9*a* of the second boom cylinder 9 is pressure-accumulated in the accumulator 59. The pressure of the head-side oil chamber 9*a* of the second boom cylinder 9 is approximately twice as much as the pressure in the bilateral holding control. Pressure-accumulated in the accumulator 59 is thus pressurized oil high enough for heavy load work such as excavation work, lifting and rotation, and so on.

When the boom operating lever is operated to the boom lowering side, the controller 27 outputs no operation signal to the accumulator flow rate control valve electro-hydraulic conversion valve 53. The accumulator flow rate control valve 52 is thus controlled to be positioned at a closed position N to close the merging oil passage 16. Pressurized oil is not supplied from the accumulator oil passage 45 through the merging oil passage 16 to the pressurized oil supplying passage 17. Only oil discharged from the main pump 10 is supplied to the pressurized oil supplying passage 17.

When the boom operating lever is operated to the boom lowering side, the controller 27 also outputs a control signal to the main pump flow rate control solenoid proportional pressure reducing valve 30 to output a flow rate control signal pressure Pc to the regulator 13 so as to set a discharge flow rate of the main pump 10 to be a flow rate calculated by a pump flow rate calculating portion 71. The discharge flow rate of the main pump 10 is thus controlled to correspond to the flow rate calculated by the pump flow rate calculating portion 71. Such main pump discharge flow rate control will be discussed more later.

Another control will now be discussed in which the boom operating lever is operated to the boom raising side, i.e., the working portion 4 is raised. The control is performed such that the head-side communicating oil passage opening and closing valve 39 is positioned at an open position X and the unload valve 41 is closed because of the bilateral holding control when the working portion 4 is raised, as discussed above.

When the boom operating lever is operated to the boom raising side, the controller 27 outputs a control signal to the raising-side solenoid proportional pressure reducing valve 25 to output a pilot pressure corresponding to an amount of the operation of the boom operating lever to the raising-side pilot port 18*a* of the boom cylinder control valve 18, The boom cylinder control valve 18 switches to be positioned at a raising-side position X. Pressurized oil in the pressurized oil supplying oil passage 17 is supplied to the head-side oil chambers 8*a* and 9*a* of the first and second boom cylinders 8 and 9 through the boom cylinder control valve 18 at the raising-side position X, Oil discharged from the rod-side oil chambers 8*b* and 9*b* is discharged to the oil tank 12.

In the above case, the controller 27 outputs no pilot pressure output control signal to the first and second solenoid proportional pressure reducing valves 35 and 36. The first and second flow rate control valves 33 and 34 are thus controlled to be positioned at a closed position N. As discussed above, the head-side communicating oil passage opening and closing valve 39 is positioned at the open position X, and the unload valve 41 is closed. The pressurized oil, which is supplied to the head-side oil chambers 8*a* and 9*a* of the first and second boom cylinders 8 and 9 through the boom cylinder control valve 18 at the raising-side position X, reaches to the head-side oil chambers 8*a* and 9*a* of the first and second boom cylinders 8 and 9 through the head-side main oil passage 22, the head-side communicating oil passage 21 and the first and second check valves 31 and 33 of the first and second head-side oil passages 19 and 20 without flowing into the oil tank 12 through the head-side oil discharge passage 40.

When the boom operating lever is operated to the boom raising side, the controller 27 also controls the cylinder-side check valve solenoid switching valve 48 and the accumulator-side check valve solenoid switching valve 51 to be positioned at an OFF position N. The cylinder-side check valve 46 and the accumulator-side check valve 49 thus stay closed, and the recovery oil passage 44 and the accumulator oil passage 45 are blocked from each other.

When the boom operating lever is operated to the boom raising side, the controller 27 also outputs an operation signal to the accumulator flow rate control valve electro-hydraulic conversion valve 53 to switch the accumulator flow rate control valve 52 to be positioned at an open position X. The accumulator flow rate control valve 52 thus opens the merging oil passage 16 that extends from the accumulator oil passage 45 to the discharge line 15 of the main pump 10. Pressurized oil that is pressure-accumulated in the accumulator 59 merges into the discharge line 15 of the main pump 10 through the accumulator oil passage 45 and the merging oil passage 16 and is further supplied to the head-side oil chambers 8*a* and 9*a* of the first and second boom cylinders 8 and 9 through the pressurized oil supplying oil passage 17 and the boom cylinder control valve 18 at the raising-side position X. In this case, an accumulator merging flow rate from the accumulator 59 to the discharge line 15 of the main pump 10 is controlled by an opening area of the accumulator flow rate control valve 52. Such accumulator flow rate control will be discussed more later.

When the boom operating lever is operated to the boom raising side, the controller 27 also outputs a control signal to the main pump flow rate control solenoid proportional pressure reducing valve 30 to output a flow rate control signal pressure Pc to the regulator 13 so as to set a discharge flow rate of the main pump 10 to be a flow rate calculated by the pump flow rate calculating portion 71. The discharge flow rate of the main pump 10 is thus controlled to correspond to the flow rate calculated by the pump flow rate calculating portion 71. Such main pump discharge flow rate control will be discussed more later.

In other words, when the working portion 4 is raised, pressure-accumulated oil in the accumulator 59 merges into oil discharged from the main pump 10 through the merging oil passage 16. The merging pressurized oil is supplied to the head-side oil chambers 8*a* and 9*a* of the first and second boom cylinders 8 and 9 through the boom cylinder control valve 18 at the raising-side position X. The hydraulic energy, which is recovered in the accumulator 59 when the working portion 4 is lowered, can thus be reused when the working portion 4 is raised.

Pressure-accumulated oil in the accumulator 59 can be used for pressurized oil to be supplied to not only the first and second boom cylinders 8 and 9 when the working portion 4 is raised but also the various hydraulic actuators A1 to An whose hydraulic power source is the main pump 10 by positioning the accumulator flow rate control valve 52 at an open position X to allow the pressure-accumulated oil in the accumulator 59 to merge into oil discharged from the main pump 10 when operating members of the hydraulic actuators A1 to An, the hydraulic supply source of which is the main pump 10, are operated or when a boom raising-side operation of the boom operating lever is performed in conjunction with the operating members of the hydraulic actuator A1 to An. In this case, the high-pressure oil is pressure-accumulated in the accumulator 59 as discussed above, which can be applied to various operations including heavy loads such as excavation work and lifting and rotation.

Figure 4:
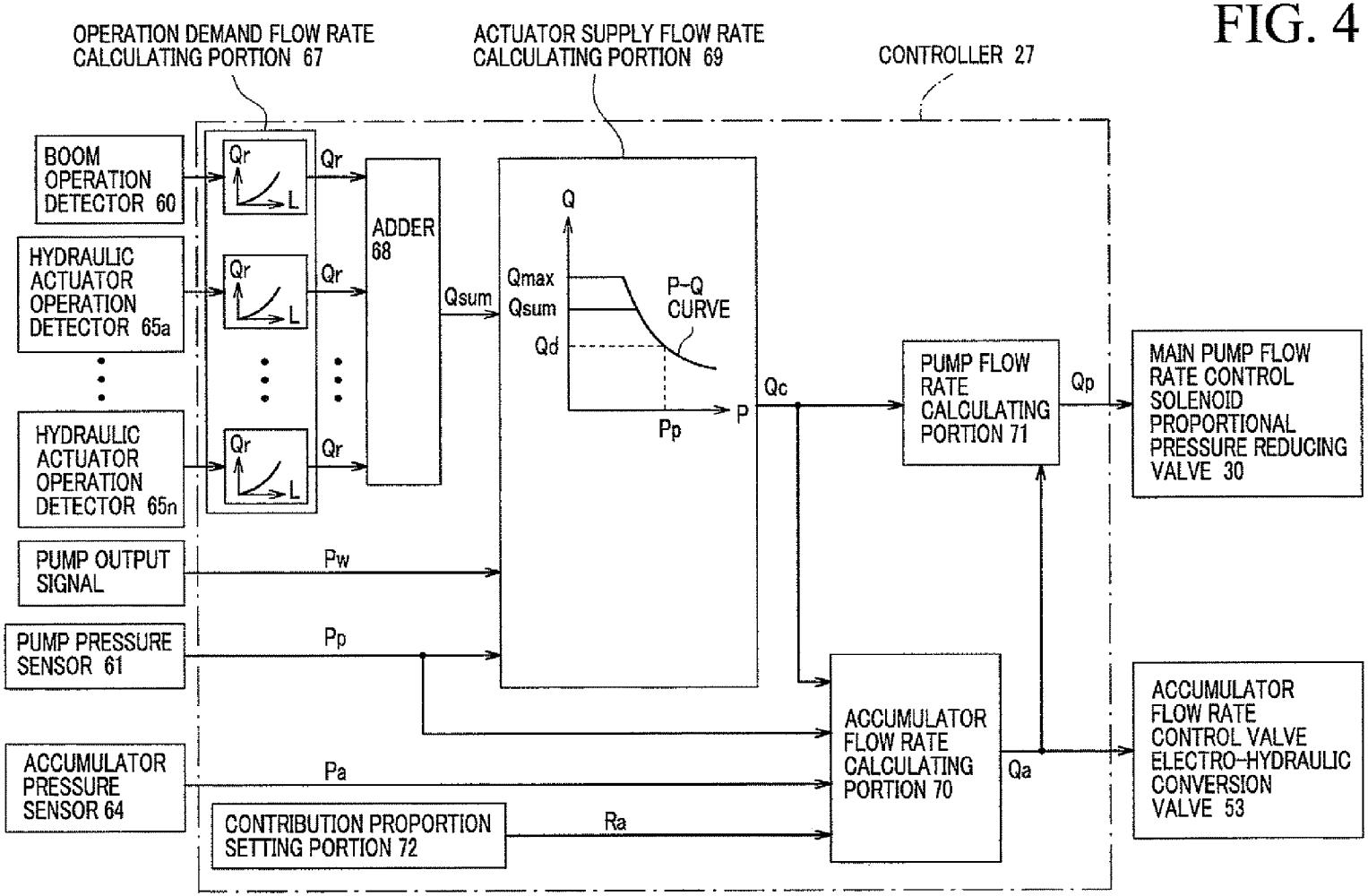
FIG. 4 is a block diagram showing a control for an accumulator flow rate and a main pump discharge flow rate.

Discussed now with reference to a block diagram as illustrated in FIG. 4 will be the accumulator flow rate control (a merging flow rate from the accumulator 59 to the discharge line 15 of the main pump 10) for merging the pressure-accumulated oil in the accumulator 59 into the oil discharged from the main pump 10 and the discharge flow rate control of the main pump 10. In order to carry out the controls, the controller 27 first calculates a flow rate to be supplied to the hydraulic actuators (first and second boom cylinders 8 and 9 and hydraulic actuators A1 to An) that are operated with the operating members. The supply flow rate is hereinafter referred to as an actuator supply flow rate Qc.

When the actuator supply flow rate Qc is calculated, the controller 27 first inputs detection signals, which are input from the boom operation detector 60 and the hydraulic actuator operation detector 65*a* to 65*n*, to an operation demand flow rate calculating portion 67. The operation demand flow rate calculating portion 67 includes a table that indicates a relationship between an operation amount L of each operating member of the hydraulic actuators and an operation demand flow rate Qr that is set according to the operation amount L of the hydraulic actuator operating members. The operation demand flow rate calculating portion 67 uses the table to determine the operation demand flow rate Qr of the respective hydraulic actuators. The operation demand flow rate Qr of the respective hydraulic actuators, which is determined by the operation demand flow rate calculating portion 67, is then summed by an adder 68 and output as a total operation demand flow rate Qsum (Qsum=Qr+Qr . . . +Qr) to an actuator supply flow rate calculating portion 69.

The actuator supply flow rate calculating portion 69 inputs the total operation demand flow rate Qsum, the detection signal of the pump pressure sensor 61 and a pump output signal Pw. The pump output signal Pw, which adjusts an output of the main pump 10 according to an output of the engine E, detailed work, etc., is set according to a dial value of an accelerator dial that sets a non-load rotation speed of the engine E, for example. A pump constant horsepower curve (P-Q curve) indicates a relationship between a pump discharge pressure P and a pump flow rate Q for performing a constant horsepower control. The P-Q curve is set in advance according to a signal value of the pump output signal Pw. The actuator supply flow rate calculating portion 69 determines a pump flow rate Qd on the pump constant horsepower curve according to the pump constant horsepower curve to be determined by the pump output signal Pw and a discharge pressure Pp of the main pump 10 to be input from the pump pressure sensor 61. The actuator supply flow rate calculating portion 69 also determines a smallest value by comparison among the pump flow rate Qd on the pump constant horsepower curve, the total operation demand flow rate Qsum and a maximum flow rate Qmax of the main pump 10, and then outputs the smallest value among the compared values as a actuator supply flow rate Qc to be supplied to the hydraulic actuators that are operated with the operating members.

The actuator supply flow rate Qc, which is output from the actuator supply flow rate calculating portion 69, is input to an accumulator flow rate calculating portion 70 to be used for calculating an accumulator flow rate Qa and simultaneously input to the pump flow rate calculating portion 71 to be used for calculating a discharge flow rate Qp of the main pump 10.

A calculation of the accumulator flow rate Qa made in the accumulator flow rate calculating portion 70 will now be discussed. The actuator supply flow rate Qc, which is output from the actuator supply flow rate calculating portion 69, multiplied by an accumulator contribution portion Ra that is set by a contribution proportion setting portion (corresponding to a contribution proportion setter of the present invention) 72 equals the accumulator flow rate Qa that merges from the accumulator 59 into the oil discharged from the main pump 10 (i.e., Qa=Qc*Ra). The calculation of the accumulator flow rate Qa is performed if a pressure Pa of the accumulator 59 that is input from the accumulator pressure sensor 64 is more than or equal to a pressure Pas that is set in advance to allow the accumulator 59 to release pressurized oil (Pa≥Pas) and if the pressure Pa of the accumulator 59 is more than or equal to the discharge pressure Pp of the main pump 10 (Pa≥Pp). If the pressure Pa of the accumulator 59 is less than the set pressure Pas or the discharge pressure Pp of the main pump 10, then pressure-accumulated oil in the accumulator 59 is not allowed to merge into the main pump 10. In this case, the accumulator flow rate Qa is calculated as "zero". In addition, the accumulator flow rate Qa is calculated as "zero" when the boom operating lever is operated to the boom lowering side because the pressure-accumulation is performed by the accumulator 59 as discussed above.

Of the actuator supply flow rate Qc, which is supplied to the hydraulic actuators, the contribution proportion setting portion 72 sets the accumulator contribution proportion Ra (0<Ra≤1) to be contributed by the accumulator 59 and the pump contribution proportion Rp (Rp=1−Ra) to be contributed by the main pump 10. For example, if the accumulator contribution proportion Ra is set to be 0.5 (Ra=0.5) and the pump contribution proportion Rp is set to be 0.5 (Rp=0.5), then a supply flow rate to the hydraulic actuators is contributed fifty-fifty by the accumulator 59 and the main pump 10. The accumulator contribution proportion Ra and the pump contribution proportion Rp, which is set in the contribution proportion setting portion 72, can be set arbitrarily according to, for example, a capacity of the accumulator 59 by using such an operation means as an operation panel to be connected to the controller 27.

The controller 27 also outputs a control signal to the accumulator flow rate control valve electro-hydraulic conversion valve 53 to control an opening area of the accumulator flow rate control valve 52 such that the accumulator flow rate Qa, which is calculated in the accumulator flow rate calculating portion 70, is allowed to merge from the accumulator 59 into the oil discharged from the main pump 10. In this case, the opening area of the accumulator flow rate control valve 52 is controlled such that the following Formula I is satisfied:

$$Qa=C*A*(Pa-Pp)^{1/2}$$

wherein Qa represents the accumulator flow rate that is calculated in the accumulator flow rate calculating portion 70; C represents a coefficient; A represents the opening area of the accumulator flow rate control valve 52; Pa represents the pressure of the accumulator 59; and Pp represents the discharge pressure of the main pump 10.

The opening area of the accumulator flow control valve 52 is controlled to change according to a pressure difference between the pressure Pa of the accumulator 59 and the discharge pressure Pp of the main pump 10. The accumulator flow rate Qa, which is calculated in the accumulator flow rate calculating portion 70, can thus be compensated even if the pressure Pa of the accumulator 59 and the discharge pressure Pp of the main pump 10 vary. In addition, when the accumulator flow rate Qa is calculated to be "zero" (Qa=0) in the accumulator flow rate calculating portion 70, the accumulator flow rate control valve 52 is controlled to be positioned at a closed position N to close the merging oil passage 16.

A calculation of the discharge flow rate Qp of the main pump 10 made in the pump flow rate calculating portion 71 will now be discussed. The pump flow rate calculating portion 71 calculates the discharge flow rate Qp of the main pump 10 by subtracting the accumulator flow rate Qa, which is calculated in the accumulator flow rate calculating portion 70, from the actuator supply flow rate Qc, which is output from the actuator supply flow rate calculating portion 69 (i.e., Qp=Qc−Qa). The calculation is thus performed such that a total flow rate of the discharge flow rate Qp of the main pump 10 and the accumulator flow rate Qa corresponds to the actuator supply flow rate Qc that is supplied to the hydraulic actuators. In addition, when the accumulator flow rate Qa is "zero", the discharge flow rate Qp of the main pump 10 corresponds to the actuator supply flow rate Qc.

The controller 27 outputs a control signal to the main pump flow rate control solenoid proportional pressure reducing valve 30 to output a flow rate control signal pressure Pc to the regulator 13 in order to allow a discharge flow rate of the main pump 10 to correspond to the discharge flow rate Qp that is calculated in the pump flow rate calculating portion 71. The discharge flow rate of the main pump 10 is thus controlled to correspond to the discharge flow rate Qp that is calculated in the pump flow rate calculating portion 71.

In the present embodiment arranged as discussed above, the unilateral holding control is performed to hold the weight of the working portion 4 by only the head-side oil chamber 9*a* of the second boom cylinder 9 when the working portion 4 is lowered. In doing so, the oil discharged from the head-side oil chamber 9*a* of the second boom cylinder 9, which holds the weight of the working portion 4, is pressure-accumulated in the accumulator 59. The high-pressure pressurized oil is pressure-accumulated in the accumulator 59, which can be utilized for heavy load operations. Further, the pressure-accumulated pressurized oil in the accumulator 59 is allowed to merge into the oil discharged from the main pump 10 through the merging oil passage 16. The hydraulic energy, which is contained in the oil discharged from the head-side oil chamber 9*a* of the second boom cylinder 9, can thus be utilized for the pressurized oil to be supplied to the first and second boom cylinders 8 and 9 and the hydraulic actuators Al to An. In this case, the accumulator flow rate Qa from the accumulator 59 to the oil discharged from the main pump 10 is controlled by the accumulator flow rate control valve 52 that is disposed to the merging oil passage 16. Based on an operation amount of the boom operating lever and the operating members for the hydraulic actuators and the discharge pressure Pp of the main pump 10, the controller 27, which controls the accumulator flow rate control valve 52 and the discharge flow rate of the main pump 10, determines the actuator supply flow rate Qc to be supplied to the hydraulic actuators (first and second boom cylinders 8 and 9 and the hydraulic actuators A1 to An) that are operated with the operating member. The controller 27 then controls the discharge flow rate of the main pump 10 and the accumulator flow rate in order to supply the actuator supply flow rate Qc as the total flow rate of the discharge flow rate Qp of the main pump 10 and the accumulator flow rate Qa.

The actuator supply flow rate Qc, which is determined based on the operation amount of the hydraulic actuator operating members and the discharge pressure Pp of the main pump 10, is allowed to be supplied without an excess and deficiency by the accumulator flow rate Qa and the discharge flow rate Qp of the main pump 10 into the pressurized oil supplying oil passage 17 that supplies the pressurized oil to the first and second boom cylinders S and 9 and the hydraulic actuators Al to An. When the pressure-accumulated oil in the accumulator 59 is used by merging into the oil discharged from the hydraulic pump 10, the pressure-accumulated oil in the accumulator 59 can be used efficiently without being wasted, i.e., without increasing a pressure loss in the control valves (the boom cylinder control valve 18 and the hydraulic actuator control valves C1 to Cn) or without varying an operation speed of the hydraulic actuators according to an increase or decrease in the total flow rate from the accumulator 59. In doing so, the discharge flow rate of the main pump 10 can thus be reduced, and a reliable energy saving is also secured, Further in the present embodiment arranged as discussed above, the controller 27 includes the contribution proportion setting portion 72 that sets the accumulator contribution proportion Ra and the pump contribution proportion Rp of the actuator supply flow rate Qc. The accumulator contribution proportion Ra is contributed by the accumulator 59, the pump contribution proportion Rp is contributed by the main pump 10, and the actuator supply flow rate Qc is supplied to the hydraulic actuators (the first and second boom cylinders 8 and 9 and the hydraulic actuators A1 to An). By multiplying the actuator supply flow rate Qc by the accumulator contribution proportion Ra, the controller 27 determines the accumulator flow rate Qa, which merges from the accumulator 59 into oil discharged from the main pump 10, if the accumulator pressure Pa, which is detected by the accumulator pressure sensor 64, is more than or equal to the set pressure Pas, which is set in advance as the pressure at which the accumulator 59 is allowed to release pressurized oil (i.e., Pa Pas) and if the accumulator pressure Pa is more than or equal to the discharge pressure Pp of the main pump 10 (i.e., Pa≥Pp). The accumulator flow rate Qa is thus controlled to contribute a predetermined proportion of the actuator supply flow rate Qc without being affected by the pressure Pa of the accumulator 59 or the discharge pressure Pp of the main pump 10. The accumulator flow rate Qa is easily calculated and controlled, and the discharge rate control of the main pump 10 is also easily performed. In addition, if the accumulator pressure Pa is less than the set pressure Pas or the discharge pressure Pp of the main pump 10, or when a pressure accumulation of the accumulator 59 is performed, i.e., when oil is not allowed to merge from the accumulator 59 into oil discharged from the main pump 10, then the accumulator flow rate Qa is calculated to be "zero", in which a total flow rate of the actuator supply flow rate Qc is supplied by the discharge flow rate Qp of the main pump 10.

Further in the present embodiment arranged as discussed above, the accumulator flow rate Qa is controlled accurately to be what is calculated by the accumulator flow rate calculating portion 70 even if there exists variation in the pressure Pa of the accumulator 59 or the discharge pressure Pp of the main pump 10, because the controller 27 controls an opening area of the accumulator flow control valve 52 based on a pressure difference between the pressure Pa of the accumulator 59 and the discharge pressure of the hydraulic pump 10 in order to compensate the accumulator flow rate Qa. A stable supply flow rate to the hydraulic actuators and a smooth operation of the hydraulic actuators are achieved.

Of course, the present invention will not be restricted to the embodiment arranged as discussed above. In the above embodiment, an opening area of the boom cylinder control valve 18 is controlled to increase or decrease in accordance with an operation amount of the boom operating lever, for example. However, another control may also be carried out such that an opening area of the boom cylinder control valve 18 is allowed to fully open regardless of an operation amount of a boom operating lever when only the boom operating lever is operated among the operating members of the hydraulic actuators whose hydraulic supply source is the main pump 10. In other words, a supply flow rate with respect to the first and second boom cylinders 8 and 9 is controlled to correspond to an actuator supply flow rate Qc even if the supply flow rate to the first and second boom cylinders 8 and 9 is not controlled at the boom cylinder control valve 18. It is because the accumulator flow rate Qa and the discharge flow rate Qp of the main pump 10 are controlled such that the actuator supply flow rate Qc, which is determined by the controller 27, is supplied to the first and second boom cylinders 8 and 9. This control, which allows the opening area of the boom cylinder control valve 18 to fully open, enables a reduced pressure loss in a passage through the boom cylinder control valve 18.

Further, the boom cylinder control valve 18 includes the center bypass valve passage 18*c* that allows pressurized oil in the pressurized oil supplying oil passage 17 to flow into the oil tank 12 when the boom cylinder control valve 18 is positioned at a neutral position N. The center bypass valve passage 18*c* is set to be closed even if a movement stroke of the spool is small when the boom cylinder control valve 18 switches to be positioned at a raising-side position X or a lowering-side position Y. The hydraulic actuator control valves C1 to Cn also include the center bypass valve passages C1*c* to Cnc similar to the center bypass valve passage 18*c* of the boom cylinder control valve 18. Discharged oil from the main pump 10 is thus allowed to flow at a minimum flow rate into the oil tank 12 through the center bypass valve passages 18*c* and C1*c* to Cnc when all the hydraulic actuators, the hydraulic supply source of which is the main pump 10, are unoperated. An oil loss by flowing into the oil tank 12 through the center bypass valve passages 18*c* and C1*c* to C1*nc* can be eliminated because the center bypass valve passages 18*c* and C1*c* to Cnc are closed when the hydraulic actuators are operated. Instead of using the above center bypass valve passages, however, the present invention can also be carried out by using control valves (boom cylinder control valve and other hydraulic actuator control valves) that include center bypass valve passages in which an opening amount thereof is set to be smaller when a movement stroke of the spool is greater. In this case, a discharge flow rate Qp of the main pump 10 is determined by adding a center bypass flow rate Qby (flow rate into the oil tank 12 through the center bypass valve passages) to a flow rate obtained by subtracting an accumulator flow rate Qa from an actuator supply flow rate Qc (i.e., Qp=Qc−Qa+Qby). The actuator supply flow rate Qc and the accumulator flow rate Qa can be determined in the same manner as in the aforementioned embodiment. The center bypass flow rate Qby can be determined using the following Formula II:

$$Qby=C*Aby*(\Delta P)^{1/2}$$

wherein C represents a coefficient; Aby represents an opening area of a center bypass valve passage of a control valve; and ΔP represents a pressure difference between the pressure before and after the center bypass valve passage.

Further, when the working portion 4 is lowered, the total amount of the discharged oil from the head-side oil chamber 9*a* of the second boom cylinder 9 is pressure-accumulated in the accumulator 59, and the pressurized oil is not allowed to flow from the accumulator oil passage 45 into the pressurized oil supplying oil passage 17, because the accumulator flow rate control valve 52 is positioned at the closed position N to close the merging oil passage 16. Alternatively, the accumulator flow rate control valve 52 can be configured to be positioned at an open position X to open the merging oil passage 16 when the working portion 4 is lowered, which in return allows a portion of oil discharged from the head-side oil chamber 9*a* of the second boom cylinder 9 to merge into oil discharged from the main pump 10. In this case, the discharged oil from the head-side oil chamber 9*a* of the second boom cylinder 9 is pressure-accumulated in the accumulator 59 and simultaneously recycled so as to be supplied to the rod-side oil chambers 8*b* and 9*b* of the first and second boom cylinders 8 and 9 through the merging oil passage 16, the pressurized oil supplying oil passage 17 and the boom cylinder control valve 18 at the lowering-side position Y. Such recycled flow rate can be controlled by an opening area of the accumulator flow rate control valve 52, and a discharge flow rate of the main pump 10 can be controlled by the recycled flow rate. The accumulator 59 can be downsized because the portion of the discharged oil from the head-side oil chamber 9*a* of the second boom cylinder 9 can be used as the recycled oil. The recycled oil can also be used for pressurized oil to be supplied to the hydraulic actuators Al to An because the recycled oil is allowed to merge into the discharged oil from the main pump 10.

Further, the weight of the working portion 4 is held when the working portion 4 is raised or not both raised and lowered by using the pressure of the head-side oil chambers 8*a* and 9*a* of the first and second boom cylinders 8 and 9, or the weight of the working portion 4 is held when the working portion 4 is lowered by using the pressure of the head-side oil chamber 9*a* of the second boom cylinder 9 and the discharged oil from the head-side oil chamber 9*a* of the second boom cylinder 9 is pressure-accumulated in the accumulator 59. The high-pressure pressurized oil can thus be pressure-accumulated in the accumulator 59, which can be applied to various heavy load works. However, the present invention is not restricted to the above configuration and indeed can also be carried out to provide a hydraulic control system for various working machines that include an accumulator that stores hydraulic energy contained in oil discharged from a hydraulic actuator; and a merging oil passage that allows the stored oil in the accumulator to merge into oil discharged from a hydraulic pump in which the discharged oil from the hydraulic actuator is increased in pressure using a pressure increasing device such as a pressure increasing cylinder or a pump or even if there is provided no such pressure increasing device.

The present invention relates to a hydraulic control system for a working machine in which hydraulic energy contained in oil discharged from a hydraulic actuator can be recovered and reused. Configurations of the present invention enable a pressure-accumulated oil in an accumulator to be used efficiently without being wasted and a discharge flow rate of the hydraulic pump to be reduced, which results in reliable energy saving. There is also industrial applicability in that a supply flow rate to the hydraulic actuators is stabilized and a smooth operation of the hydraulic actuators is provided because of a precise control over an accumulator merging flow rate from the accumulator to oil discharged from the hydraulic pump.

The invention claimed is:

1. A hydraulic control system in a working machine comprising:

a plurality of hydraulic actuators;

an accumulator that pressure-accumulates hydraulic energy contained in oil discharged from a hydraulic actuator of the plurality of hydraulic actuators;

a variable-capacity hydraulic pump that serves as a hydraulic supply source for the plurality of hydraulic actuators;

a merging oil passage that allows pressure-accumulated oil in the accumulator to merge into oil discharged from the hydraulic pump;

an accumulator flow rate control valve that controls an accumulator flow rate to be merged from the accumulator into the oil discharged from the hydraulic pump; and a controller that controls the accumulator flow rate control valve and a discharge flow rate of the hydraulic pump, wherein the controller:

determines a minimum value among an operation demand flow rate to be demanded by an operation amount of hydraulic actuator operating members, a pump flow rate to be determined by a discharge pressure of the hydraulic pump under a constant horsepower control and a maximum flow rate of the hydraulic pump such that the determined minimum value is an actuator supply flow rate to be supplied to the plurality of hydraulic actuators, and controls the discharge flow rate and the accumulator flow rate so as to supply the actuator supply flow rate corresponding to a total flow rate of the discharge flow rate and the accumulator flow rate.

2. The hydraulic control system in the working machine according to claim 1, wherein the controller:

sets an accumulator contribution proportion to be contributed by the accumulator and a pump contribution proportion to be contributed by the hydraulic pump of the actuator supply flow rate to be supplied to the hydraulic actuators, and determines the accumulator flow rate to be merged from the accumulator into the oil discharged from the hydraulic pump by multiplying the actuator supply flow rate by the accumulator contribution proportion if an accumulator pressure that is detected is more than or equal to a predetermined pressure at which the accumulator is allowed to release pressurized oil and if the detected accumulator pressure is more than or equal to the discharge pressure of the hydraulic pump.

3. The hydraulic control system in the working machine according to claim 1, wherein the controller determines the accumulator flow rate to be merged from the accumulator into the oil discharged from the hydraulic pump by multiplying the actuator supply flow rate by an accumulator contribution proportion.

4. The hydraulic control system in the working machine according to claim 1, wherein the controller controls an opening area of the accumulator flow rate control valve such that the following formula is satisfied:

$$Qa=C*A*(Pa-Pp)^{1/2}$$

where Qa represents the accumulator flow rate; C represents a coefficient; A represents the opening area of the accumulator flow rate control valve; Pa represents accumulator pressure; and Pp represents the discharge pressure of the hydraulic pump.

5. The hydraulic control system in the working machine according to claim 1, wherein the hydraulic control system is configured such that a unilateral holding control is performed to hold a weight of a working portion of the working machine by only the hydraulic actuator of the plurality of hydraulic actuators such that the oil discharged from the hydraulic actuator of the plurality of hydraulic actuators is pressure-accumulated in the accumulator.

* * * * *